US005347929A

United States Patent [19]

Lerche et al.

[11] Patent Number: 5,347,929

[45] Date of Patent: Sep. 20, 1994

[54] FIRING SYSTEM FOR A PERFORATING GUN INCLUDING AN EXPLODING FOIL INITIATOR AND AN OUTER HOUSING FOR CONDUCTING WIRELINE CURRENT AND EFI CURRENT

[75] Inventors: Nolan C. Lerche, Stafford; Clifford L. Aseltine, Houston, both of Tex.; Wallace E. Voreck, Jr., Sparta, N.J.

[73] Assignee: Schlumberger Technology Corporation, Houston, Tex.

[21] Appl. No.: 116,082

[22] Filed: Sep. 1, 1993

[51] Int. Cl.[5] ..... F42C 11/00

[52] U.S. Cl. ..... 102/202.14

[58] Field of Search ..... 102/202.14, 200, 202.5, 102/202.7, 206

[56] References Cited

U.S. PATENT DOCUMENTS

| | | | |
|---|---|---|---|
| 3,978,791 | 9/1976 | Lemley et al. | 102/202.14 |
| 4,441,427 | 4/1984 | Barrett | 102/202.6 |
| 4,471,697 | 9/1984 | McCormick et al. | 102/200 |
| 4,762,067 | 8/1988 | Barker et al. | 102/202.14 |
| 4,788,913 | 12/1988 | Stroud et al. | 102/202.5 |
| 4,944,225 | 7/1990 | Barker | 102/202.5 |
| 5,088,413 | 2/1992 | Huber et al. | 102/200 |

*Primary Examiner*—Daniel T. Pihulic

*Attorney, Agent, or Firm*—Henry N. Garrana; John H. Bouchard

[57] ABSTRACT

A firing head for a firing system adapted for use in a perforating gun includes an outer pressure bulkhead housing which simultaneously conducts two separate and independent currents: a wireline current from a wireline and a return current from an initiator embodied in the firing head. A fire set circuit provides a discharge pulse to the firing head, and a wireline conductor cable provides a wireline current to the fire set circuit. The firing head includes an outer pressure bulkhead housing adapted for conducting the wireline current from the wireline conductor cable to the fire set circuit, and an exploding foil initiator (EFI) responsive to the discharge pulse from the fire set circuit for initiating the detonation of a secondary explosive. The discharge pulse energizing the firing head passes through the exploding foil initiator (EFI) and emerges from the EFI as an EFI return current. As a result, the outer pressure bulkhead housing of the firing head conducts two separate and independent currents: the EFI return current from the EFI to a ground potential, and the wireline current from the wireline conductor cable to the fire set circuit.

22 Claims, 7 Drawing Sheets

| |
|---|
| FIG. 1 |
| FIG. 2 |

FIG. 4
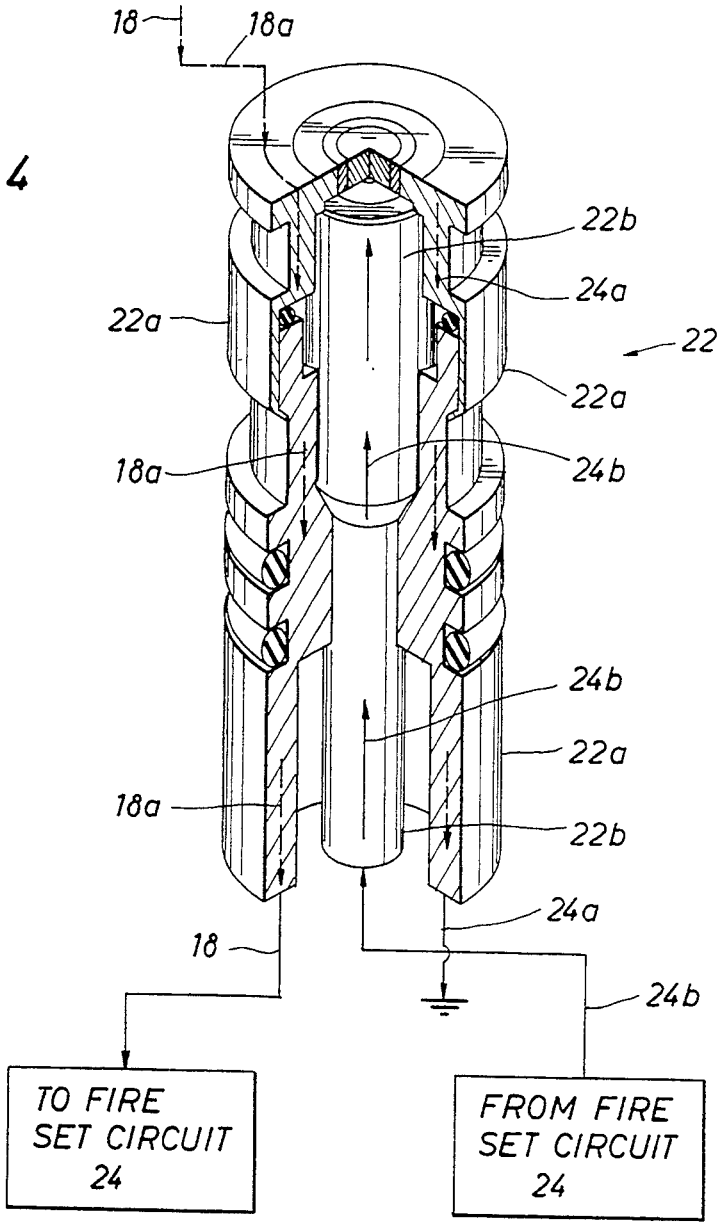
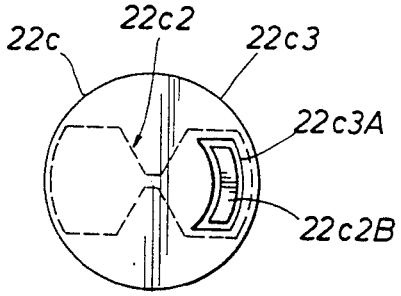
FIG. 7
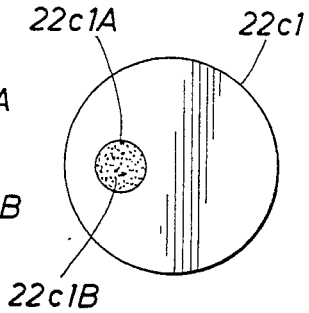
FIG. 8
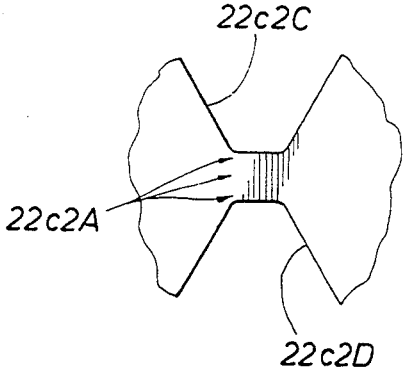
FIG. 9

FIRING SYSTEM FOR A PERFORATING GUN INCLUDING AN EXPLODING FOIL INITIATOR AND AN OUTER HOUSING FOR CONDUCTING WIRELINE CURRENT AND EFI CURRENT

BACKGROUND OF THE INVENTION

The subject matter of the present invention relates to a firing system adapted for use in a perforating gun connected to a wireline conductor cable in a wellbore, and more particularly, to an exploding foil initiator (EFI) firing system for use in the perforating gun, the EFI firing system including an outer housing adapted to function as an electrical conductor for conducting a return current to ground potential from the EFI firing system and a wireline current from the wireline conductor cable.

Exploding foil initiators (EFI) have been used for initiating the detonation of a secondary explosive. For example, U.S. Pat. No. 4,788,913 to Stroud et al discloses a typical exploding foil initiator. In addition, U.S. Pat. No. 3,978,791 to Lemley et. al. and U.S. Pat. No. 4,471,697 to McCormick et. al. also disclose exploding foil initiator or "slapper" detonators. Furthermore, U.S. Pat. No. 4,441,427 to Barrett and U.S. Pat. No. 4,762,067 to Barker et al disclose the use of Exploding Foil Initiators in a perforating gun for propelling a flying plate into a secondary explosive and detonating the perforating gun. In addition, U.S. Pat. No. 5,088,413 to Huber et. al. discloses an exploding foil bubble activated initiator for use in a perforating gun, the Huber et. al. patent being incorporated by reference into this specification. However, although these initiators perform well, certain additional problems, associated with the use and/or performance of the EFI initiators in general and the exploding foil bubble activated initiator of the Huber et al. patent in particular, in a perforating gun wellbore environment, have yet to be solved.

For example, initiation of a perforating gun string in a wellbore can be accomplished using secondary explosives, such as HNS4. This explosive can be initiated using an EFI initiator that receives a high energy pulse from a fire set. Typically, the fire set consists of a high voltage power supply, an energy storage capacitor, and a switch that rapidly dumps stored energy into the EFI through a high frequency connector. This connector must have a very low effective series resistance (ESR). However, after detonation, the fire set must be contained in a protected housing which is isolated from the well fluids and the pressures in the wellbore. Therefore, a pressure bulkhead must be electrically and physically connected to the fire set and the EFI for electrically connecting the fire set and the EFI to ground potential so that the EFI can ultimately detonate the secondary explosives in the perforating gun string. In addition, when perforating oil wells, sometimes it is necessary to selectively shoot multiple guns in the same gun string. In order to detonate the gun selectively, the wireline voltage must pass through the upper guns in order to reach the lower guns in the gun string. Therefore, the pressure bulkhead which provides the EFI pulse must also provide a means to transfer the wireline voltage through the guns in the gun string. Typically, this is accomplished using a separate wireline feed through. When shooting perforating guns in a bottom up configuration, a detonating element must be placed on the bottom of the gun and the shaped charges are positioned above the detonating element in the perforating gun. This prevents a gun from detonating when the gun is partially flooded. A bottom-up configuration again requires that the wireline pass through the bulkhead of the EFI detonating element in order for the wireline to be connected to the bottom side of the detonating element. However, such a pressure bulkhead is very expensive to manufacture and is a short life part. In addition, the conventional bulkhead electrical property does not lend itself well to conducting a rapid high energy discharge pulse. Usually, the parameters of a bulkhead electrical property that suffer are the effective series resistance (ESR) and the effective series inductance (ESI). Since typical values of ESR and ESI are quite large, the energy storage capacitor inside the EFI must also be large. In addition, however, a wireline feedthrough for an EFI is difficult to fabricate for gun strings having small diameters.

SUMMARY OF THE INVENTION

Accordingly, it is a primary object of the present invention to provide a firing system adapted for use in a perforating gun having an outer housing pressure bulkhead which has a low effective series resistance and a low effective series inductance and which provides an electrical current signal conducting path for two separate and independent currents.

It is a further object of the present invention to provide a firing system including an initiator adapted for use in a perforating gun including an outer housing pressure bulkhead which provides a conducting path for two separate currents, one current being a return current conducting from the initiator to ground potential, and another current being a wireline current conducting from a wireline conductor cable to the initiator for purposes of detonating the initiator.

It is a further object of the present invention to provide a firing system adapted for use in a perforating gun including an initiator for initiating detonation of the firing system, a fire set circuit electrically connected to the initiator for providing a firing current to the initiator and an outer housing enclosing the initiator for providing a conducting path for two separate currents, one current being a return current from the initiator to ground potential, and another current being a wireline current conducting from a wireline conductor cable to the initiator in the firing system for purposes of detonating the initiator.

In accordance with these and other objects of the present invention, a firing head for a firing system adapted for use in a perforating gun includes an outer pressure bulkhead housing which simultaneously conducts two separate and independent currents, that is, a wireline current from a wireline and a return current from an initiator embodied in the firing head. A fire set circuit provides a discharge pulse to the firing head, and a wireline conductor cable provides a wireline current to the fire set circuit. The firing head includes an outer pressure bulkhead housing for enclosing the firing head, and an exploding foil initiator (EFI) responsive to the discharge pulse from the fire set circuit for initiating the detonation of a secondary explosive. The discharge pulse energizing the firing head passes through the exploding foil initiator (EFI) and emerges from the EFI as a return current. Due to the geometry of the outer pressure bulkhead housing of the firing head, the pressure bulkhead has a low Effective Series Resistance (ESR) and a low Effective Series Inductance (ESI). As a result of this and a floating ground, the outer pressure bulkhead housing of the firing head is capable of efficiently conducting two separate and independent currents: the return current from the EFI to a ground potential, and the wireline current from the wireline conductor cable to the fire set circuit.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 4 illustrates a firing head embodied within the firing system of FIG. 1;

FIGS. 7–13 illustrate views of various portions of the firing head of FIGS. 4–6;

DETAILED DESCRIPTION OF THE PREFERRED EMBODIMENT

Figure 1:
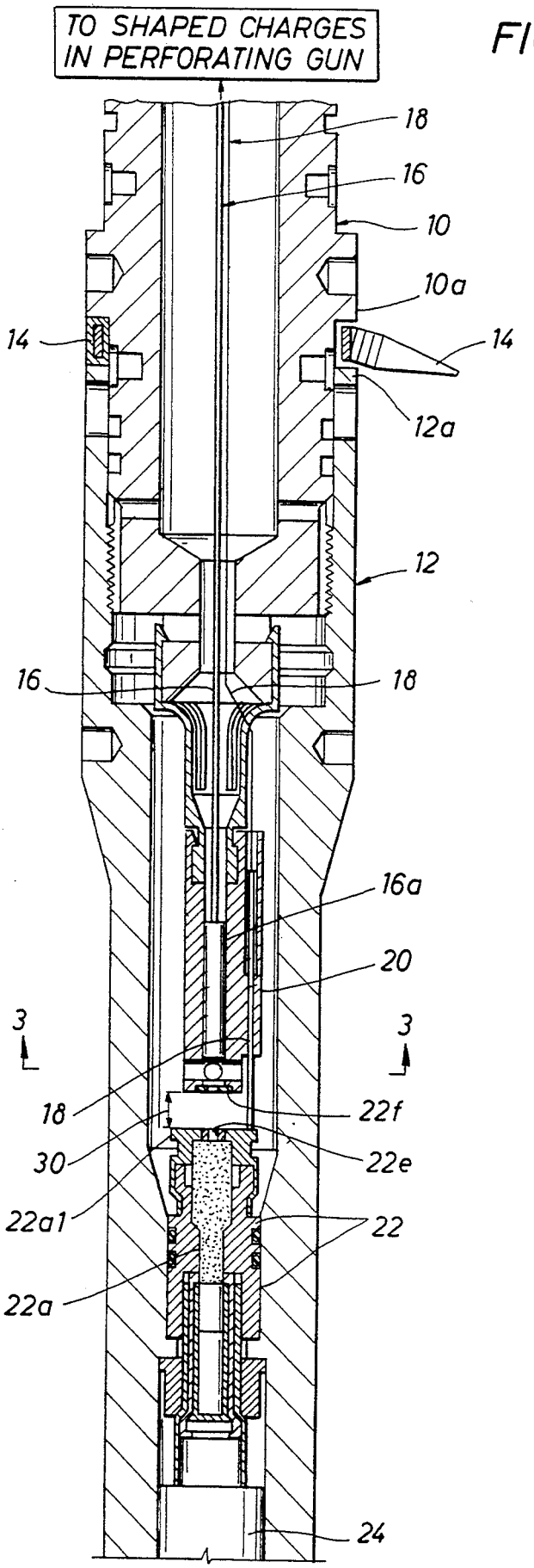
FIGS. 1 and 2 illustrate a firing system adapted to be disposed in a perforating gun in accordance with the present invention.
Figure 3:
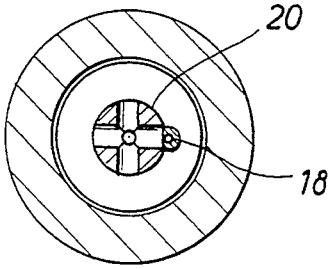
FIG. 3 illustrates a cross section of FIG. 1 taken along section lines 3—3 of FIG. 1.
Figure 2:
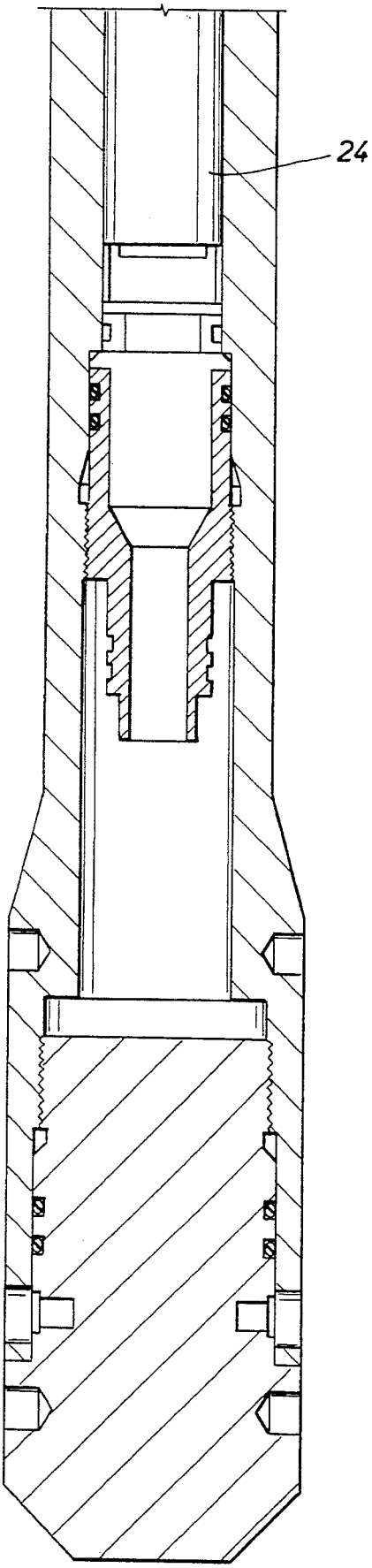

Referring to FIGS. 1 through 3, a firing system, adapted for use with a perforating gun, is illustrated. The perforating gun is adapted to be disposed in a wellbore.

In FIGS. 1 and 2, a first housing 10 is threadedly connected to a second housing 12; however, a tie wrap 14 prevents the second housing 12 from approaching and contacting the first housing 10 as long as the tie wrap 14 is in place as shown in FIG. 1. The tie wrap 14 is a safe-am device. It can easily be removed from its location shown in FIG. 1; and, when the tie wrap 14 is removed, the second housing 12 can be moved toward the first housing 10 thereby allowing the tip 12*a* of the second housing 12 to contact the tip 10*a* of the first housing 10. When the tips 12*a*/10*a* of the first and second housings 10 and 12 contact each other, the firing system of FIGS. 1–2 is armed. A detonating cord 16 and a wireline cable 18 are disposed adjacent one another within the interior of the first and second housings 10 and 12. The wireline cable 18 runs, at its top end, to the surface of the wellbore; and the detonating cord 16 is connected, at its top end, to a plurality of shaped charges in the perforating gun for detonating the shaped charges in a bottom-up firing sequence. The detonating cord 16 is connected, at its bottom end, to a booster 16*a*. The wireline cable 18 is disposed within a housing 20 which encloses the booster 16*a* of the detonating cord 16 and is further connected, at its bottom end, to a firing head 22 in accordance with the present invention. When the firing head 22 of the present invention detonates, the booster 16*a* ignites and detonates which initiates the propagation of a detonation wave in the detonating cord 16. The detonation wave begins to propagate upwardly through the detonating cord 16 to the plurality of shaped charges in the perforating gun. The shaped charges of the perforating gun are disposed above the firing head 22 in FIG. 1 (a bottom-up configuration); therefore the shaped charges detonate from bottom to top as described in the background section of this specification. As a result, when the shaped charges in the perforating gun detonate, a jet is formed from each shaped charge, starting with the lowermost shaped charge and ending with the uppermost shaped charge. The jets perforate a formation traversed by the wellbore, starting with a lowermost part of the formation and ending with an uppermost part of the formation. Well fluid begins to flow from the perforated formation.

A power supply or fire set circuit 24 is electrically connected to the firing head 22. The fire set circuit 24 receives its energizing current from the wireline cable 18. A wireline current conducting in the wireline cable 18 energizes the fire set circuit 24 and, in response, the fire set circuit 24 provides the high energy discharge pulse to the firing head 22. In response, the firing head 22 ignites and detonates the booster 16*a* as described above.

FIG. 3 illustrates a cross section of FIG. 1 taken along section lines 3—3 of FIG. 1.

Referring to FIG. 4, a three dimensional view of the firing head 22 of FIG. 1 is illustrated.

In FIG. 4, the firing head 22 comprises an outer pressure bulkhead housing 22*a* and a pin 22*b* disposed within the interior of the pressure bulkhead 22*a*. Not shown in FIG. 4 is an EFI bridge disposed on top of the pin 22*b*, an EFI barrel disposed on top of the EFI bridge, and a secondary (HE) explosive disposed on top of the EFI barrel. These components will be illustrated in FIG. 5. However, note in FIG. 4 that two separate and independent currents are flowing in the outer pressure bulkhead housing 22*a*. The first current flowing in the pressure bulkhead 22*a* is the wireline current 18*a* conducting from the wireline cable 18, and the second current flowing in the pressure bulkhead 22*a* is the EFI return current 24*a* to EFI ground. The EFI ground potential is the same potential as to wireline power and is also floating in respect to all other potentials and, in particular, to tool ground.

The EFI return current 24*a* is the return current to ground potential from an exploding foil initiator (EFI) which is disposed on the top of pin 22*b*. An EFI current 24*b* originating from the fire set circuit 24 propagates upwardly through the pin 22*b* and moves toward to the top of the pin 22b where it energizes the EFI disposed on the top of the pin 22b. The EFI return current flows out of the EFI, into the outer pressure bulkhead housing 22a, and down the sides of the pressure bulkhead housing 22a to ground potential. Simultaneously, wireline current 18a from wireline 18 flows down the sides of the pressure bulkhead housing 22a, and out the pressure bulkhead 22a on its way toward the fire set circuit 24.

Due to the geometry (size, shape, volume) of the pressure bulkhead housing 22a, the housing 22a exhibits a low effective series resistance and a low effective series inductance. As a result, the pressure bulkhead 22a will easily conduct a rapid high energy discharge pulse from the fire set circuit 24.

Figure 5:
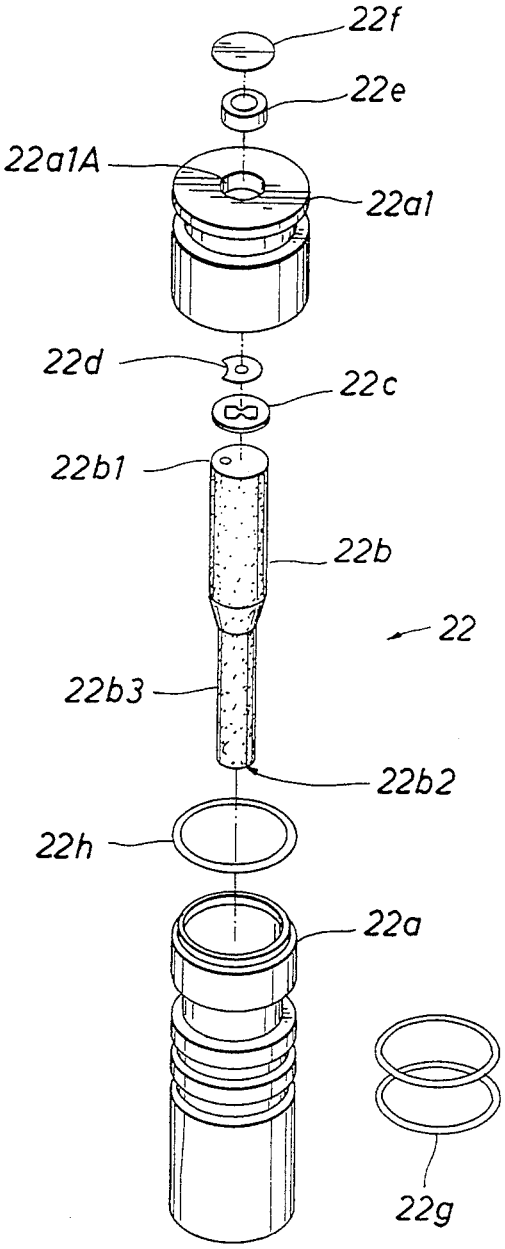
FIG. 5 illustrates a disassembled view of the firing head of FIG. 4.

Referring to FIG. 5, an exploded view of the flowing head 22 of FIG. 4 is illustrated.

In FIG. 5, the outer pressure bulkhead housing 22a encloses the pin 22b. The pin 22b is made of stainless steel (an electrically conductive material); however, substantially the entire surface area of the pin 22b is coated with a polymide based insulating material 22b3 known as "PYRL-ML" manufactured by E. I. Dupont DeNemours (Dupont) Corporation. The PYRL-ML insulating coating 22b3 covers the entire surface area of the pin 22b except for: (1) one circular area 22b 1 disposed on the top of the pin 22b, and (2) the bottom 22b2 surface area of the pin. The circular area 22b1 on the top of the pin 22b appears to be a dot; however, the dot actually represents a conductive pad area for conducting an electrical current from the pin 22b. The bottom 22b2 surface area of the pin 22b is not coated with the PYRL-ML insulating coating 22b3 because the bottom surface area 22b2 of pin 22b is plugged into a female electrical connector which conducts a high energy discharge pulse to the pin 22b from the fire set circuit 24. An EFI bridge 22c is disposed on the top of the pin 22b. The exact orientation of the EFI bridge 22c on the top of pin 22b is important, this orientation being discussed with reference to FIG. 6 of the drawings. An EFI barrel 22d is disposed over the EFI bridge 22c, the EFI barrel 22d having a hole disposed in the center. This hole and its function will discussed later in this specification. The outer pressure bulkhead housing 22a includes a top ground cap 22a1. A center bore 22a1A is disposed through the center of the ground cap 22a1, and a secondary explosive in the form of a cylindrical pellet 22e (the secondary explosive being FIE) fits snugly within the center bore 22a1A of the ground cap 22a1. A metal flyer 22f is disposed above the secondary explosive pellet 22e. When the pellet 22e detonates, a flying plate is cut from the center of the flyer 22f, the flying plate flying across a space and impacting the booster 16a of the detonating cord 16 in FIG. 1 thereby initiating the propagation of a detonation wave in the detonating cord 16. The shaped charges in a perforating gun will detonate in response to the detonation wave. Following detonation, O-rings 22g and 22h seal the pin and bulkhead thereby preventing fluid invasion beyond the bulkhead.

Figure 6:
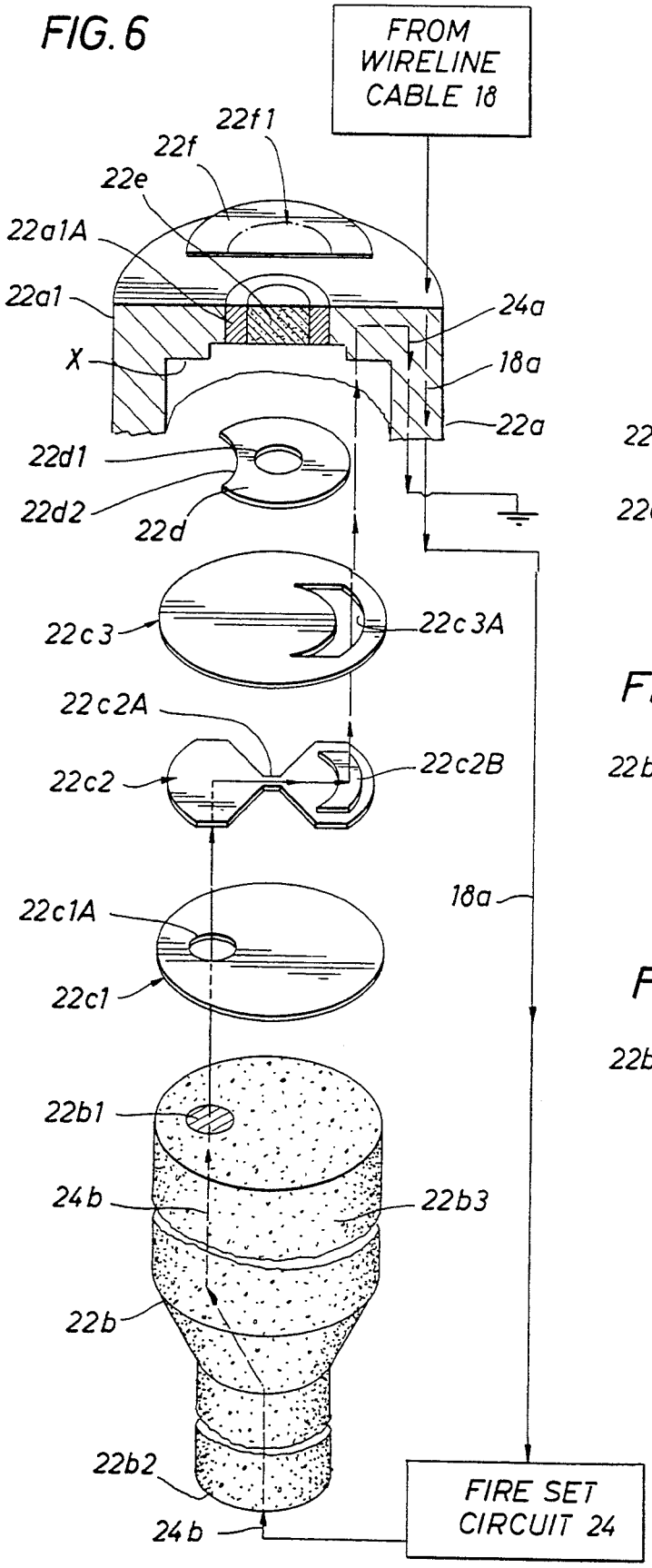
FIG. 6 illustrates a three-dimensional and enlarged view of a substantial portion of the firing head of FIGS. 4–5.

Referring to FIG. 6, an enlarged three dimensional view of the pin 22b, EFI bridge 22c, EFI barrel 22d, ground cap 22a1, secondary explosive pellet 22e and flyer 22f of FIG. 5 is illustrated.

In FIG. 6, the pin 22b is coated with the PYRL-ML insulating coating 22b3 of figure except for a conductive pad area 22b 1 disposed on the top of the pin 22b and the bottom surface area 22b2 on the bottom of the pin. Since the pin 22b is made of stainless steel, it can easily conduct an electrical current. The current is provided by the fire set circuit 24 which provides a high energy discharge pulse, the discharge pulse conducting from the bottom surface area 22b2, up the center part of the pin 22b, and toward the conductive pad area 22b1. The EFI bridge 22c is comprised of three layers, a first layer 22c1, a second layer 22c2, and a third layer 22c3. The first layer 22c1 is 1 mil in thickness and is comprised of a polyimide material. One such polyimide material to use for the first layer 22c1 is a material known as "Kapton". The Kapton polyimide material is manufactured by E. I. DuPont De Nemours, Incorporated (Dupont). The first layer 22c1 includes a hole 22c1A which is filled with a conductive epoxy in order to facilitate the conductance of an electrical current (the high energy discharge pulse from the fire set circuit 24) from the pin 22b, into the conductive pad area 22b1, and into the conductive epoxy which fills the hole 22c1A of the first layer 22c1. The second layer 22c2 of the EFI bridge 22c is approximately 170 micro-inch in thickness, is comprised of a Copper material, and is electroplated to the first layer 22c1. The Copper material of the second layer 22c2 is an electrically conductive material and was selected to receive the high energy discharge pulse, from the conductive epoxy in hole 22c1A, into a first left hand portion of the copper second layer 22c2 and to further conduct the pulse through a center neck section 22c2A of the copper second layer 22c2 toward a second right hand portion of the copper second layer 22c2 where a crescent conductive pad area 22c2B is disposed. The crescent conductive pad area 22c2B on the second layer 22c2 of the EFI bridge 22c is electrically connected to a conductive epoxy which is disposed within a hole 22c3A of the third layer 22c3 of the EFI bridge 22c, the conductive epoxy in the hole 22c3A being electrically connected to a shoulder X which is disposed around an interior of the ground cap 22a1 of the outer pressure bulkhead housing 22a. The high energy discharge pulse from the second right hand portion of the copper second layer 22c2 conducts into the crescent conductive pad area 22c2B and eventually conducts through the conductive epoxy in the hole 22c3A and into the ground cap 22a1 of the outer pressure bulkhead housing 22a. The third layer 22c3 of the EFI bridge 22c is 1 mil in thickness and is comprised of the Kapton polyimide material. The third layer 22c3 includes the hole 22c3A, in which a conductive epoxy is disposed, which has a shape which conforms to the shape of the crescent conductive pad 22c2B of the second layer 22c2.

The EFI barrel 22d is actually a spacer layer made of a polyamide material. The EFI barrel 22d is 0.010 inches in thickness and is 0.25 inches in diameter and includes a hole 22d1 which is 0.055 inches in diameter and is 0.010 inches in height. As will be explained further in this specification, when a bubble forms in the third layer 22c3 of the EFI bridge 22c, the hole 22d1 of the EFI barrel 22d guides, forms, and shapes the bubble before the bubble impacts the secondary explosive pellet 22e. As noted earlier, the outer pressure bulkhead housing 22a includes the ground cap 22a1 which is disposed above the EFI barrel 22d. The ground cap 22a1 includes a center bore in which a secondary explosive (HE) pellet 22e is disposed. The pellet 22e is positioned directly above the hole 22d1 in the EFI barrel 22d and directly above the neck section 22c2A of the copper second layer 22c2 of the EFI bridge 22c. The flyer 22f is disposed directly above the ground cap 22a1. When the secondary explosive pellet 22edetonates, a flying plate 22f1 is sheared off the flyer 22f. As will be noted later in this specification, the flying plate 22f1 flys across a space and impacts the booster 16a of the detonating cord 16 in FIG. 1.

Referring to FIG. 7, a top view of the second layer 22c2 and the third layer 22c3 of the EFI bridge 22c of FIGS. 5 and 6 is illustrated. Note how the crescent conductive pad area 22c2B is electrically connected to a conductive epoxy disposed within the hole 22c3A in the third layer 22c3 and how the conductive epoxy in hole 22c3A is electrically connected to the shoulder X of the outer pressure bulkhead housing 22a.

Referring to FIG. 8, a top view of the first layer 22c1 of the EFI bridge 22c is illustrated. Note the hole 22c1A in the first layer 22c1. As noted earlier, the hole 22c1A is filled with a conductive epoxy 22c1B in order to facilitate the conductance of the discharge pulse from the fire set circuit 24, through the pin 22b, the conductive pad area 2261 and the epoxy 22c1B to the second layer 22c2 of the EFI bridge 22c.

Referring to FIG. 9, the geometry associated with the neck section 22c2A of the second layer 22c2 of the EFI bridge 22c, before the neck section has vaporized in response to the discharge pulse from the fire set circuit 24, is illustrated. Before vaporization of the neck section, the first left hand portion 22c2C of the second layer 22c2 is integrally connected to the neck section 22c2A, the neck section being integrally connected to the second right hand portion 22c2D of the second layer 22c2 . When the discharge pulse from the fire set circuit 24 passes through the neck section 22c2A (of FIG. 6), the neck section vaporizes and disappears. FIG. 9 illustrates the neck section 22c2A of the second layer 22c2 of the EFI bridge 22c before the neck section vaporized and disappeared as a result of the discharge pulse current passing through neck section.

Figure 10:
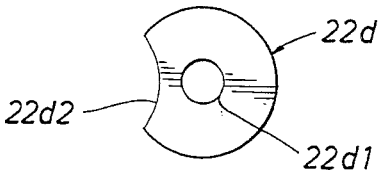

Referring to FIG. 10, the EFI barrel 22d is illustrated. The barrel 22d has a hole 22d1 disposed through its center, the hole guiding and forming a bubble from the third layer 22c3 during the passage of the bubble through the hole 22d1 toward the secondary explosive pellet 22e. The barrel 22dincludes a notch 22d2. The notch 22d2 is needed to allow pressure to be applied to the top of the conductive pad area 22b1, via the conductive epoxy in hole 22c1A, during attachment of the EFI to the pin 22b.

Figure 11:
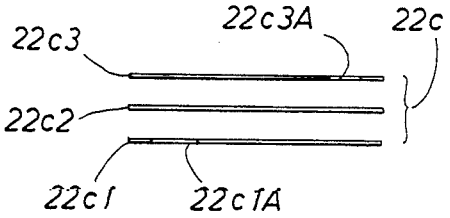

Referring to FIG. 11, another view of the first, second and third layers of the EFI bridge 22c is illustrated. As noted in FIG. 6, the EFI bridge 22c includes a first layer 22c1, a second layer 22c2 and a third layer 22c3. The first layer 22c1A includes a hole 22c1A, and the third layer 22c3 has a hole 22c3A which corresponds to the shape of the crescent shaped conductive pad 22c2B of the second layer 22c2 of the EFI bridge 22c. The hole 22c3A in the third layer 22c3 allows the crescent pad 22c2B to electrically contact the shoulder X of the ground cap 22a1 of the outer pressure bulkhead housing 22a via the conductive epoxy in hole 22c3A.

Figure 12:
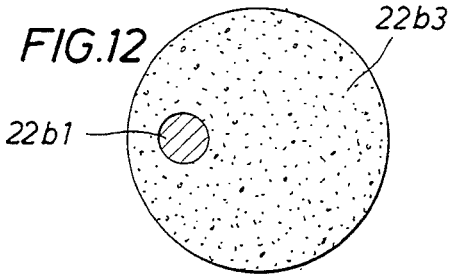

Referring to FIG. 12, the top of pin 22b is illustrated. The top part of pin 22b is coated with a PYRL-ML insulating coating 22b3, where the PYRLML polyamide based dielectric insulating coating is manufactured by Dupont Corporation. However, a small portion 22b1 of the top part of pin 22b is not coated with the insulating coating 22b3 thereby allowing the electrically conductive material (stainless steel) of the pin 22b to show therethrough, this small portion 22b I forming a dot, the dot representing an electrically conductive pad area 22b1 for conducting an electrical current.

Figure 13:
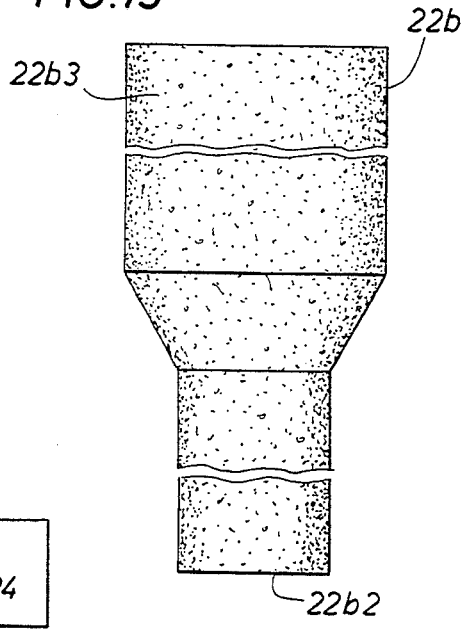

Referring to FIG. 13, the pin 22b is coated on its sides (but not on its bottom 2262) with the PYRL-ML insulating coating 22b3. As noted earlier, the pin 22b itself (without the coating) is made of an electrically conductive stainless steel material; however, substantially the entire surface area is coated with the insulating coating 22b3 except for the bottom 22b2(which is adapted to be connected to an electrical connector) and the dot conductive pad area 22b 1 disposed on the top of the pin.

Figure 14:
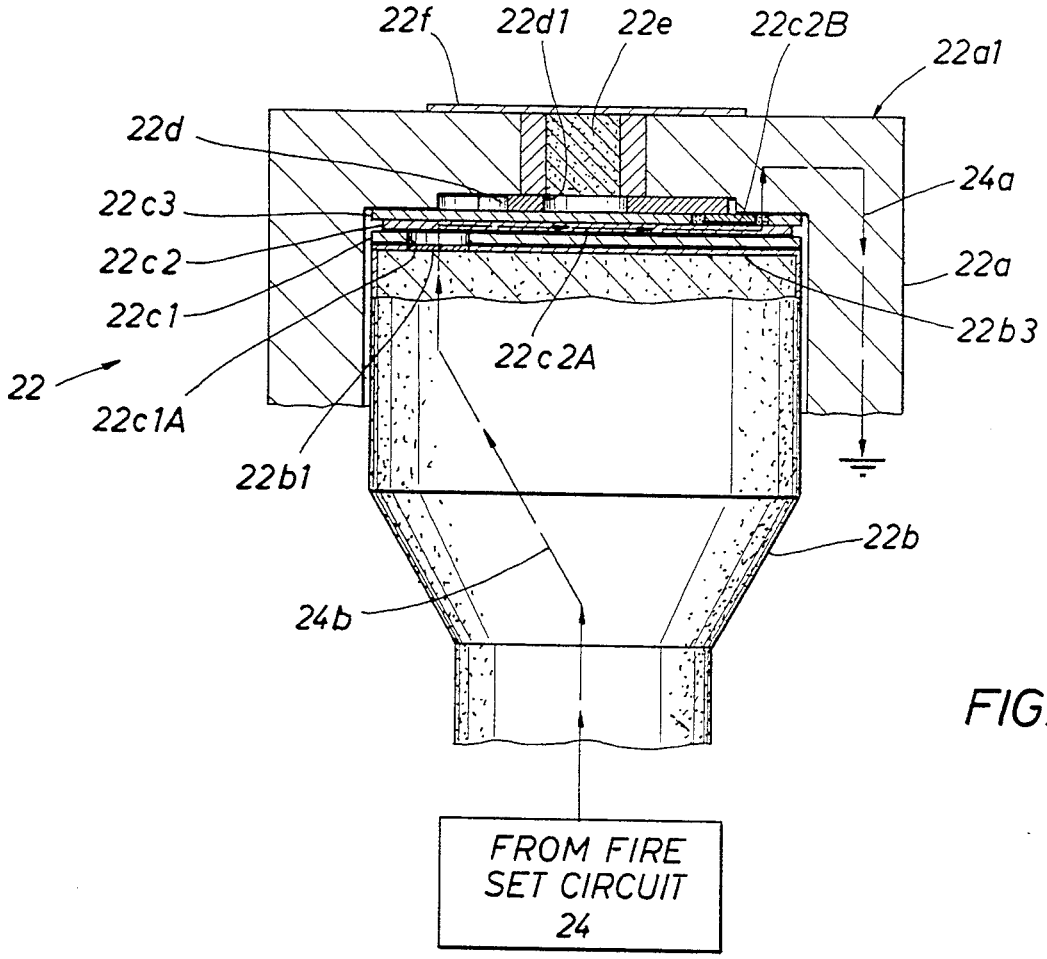
FIG. 14 illustrates a longitudinal cross sectional view of the firing head shown in FIG. 6 in a state which exists prior to detonation of the EFI in the firing head.

Referring to FIG. 14, a longitudinal cross sectional view of the firing head 22 shown in FIG. 6 is illustrated in a state which exists prior to detonation of the exploding foil initiator (EFI) in the firing head 22. A functional description of the operation of the firing head 22, prior to vaporization of the neck section 22c2A of the second layer 22c2 and detonation of the secondary explosive pellet 22e, will be set forth in the following paragraph with reference to FIG. 14.

In FIG. 14, the discharge pulse 24b from the fire set circuit 24 passes through the center of the pin 22b. An insulating coating 22b3 coats substantially the entire surface area of the pin; however, a hole in the coating exposes a conductive pad area 22b1. The discharge pulse 24b passes through the conductive pad area 22b1, through the conductive epoxy in the hole 22c1A in the first layer 22c1 of the EFI bridge 22c, and into the second layer 22c2 of the EFI bridge 22c. The discharge pulse current 24b propagates from the left hand portion 22c2C of the second layer 22c2 of the EFI bridge 22c, through the neck section 22c2 A, and toward the right hand portion 22c2D of the second layer (see FIG. 9). The current which emerges from the neck section 22c2A of the second layer 22c2 of the EFI bridge 22c is now called the EFI return current 24a. The EFI return current 24a propagates from the right hand portion 22c2D of the second layer 22c2 into the crescent conductive pad area 22c2B disposed on the second layer, the EFI return current 24a continuing to propagate from the crescent conductive pad area 22c2B into the ground cap 22a1 of the outer pressure bulkhead housing 22a. The EFI return current 24a propagates from the ground cap 22a1 down the sides of the outer pressure bulkhead housing 22ato ground potential in the manner shown in FIGS. 4 and 6 of the drawings.

Figure 15:
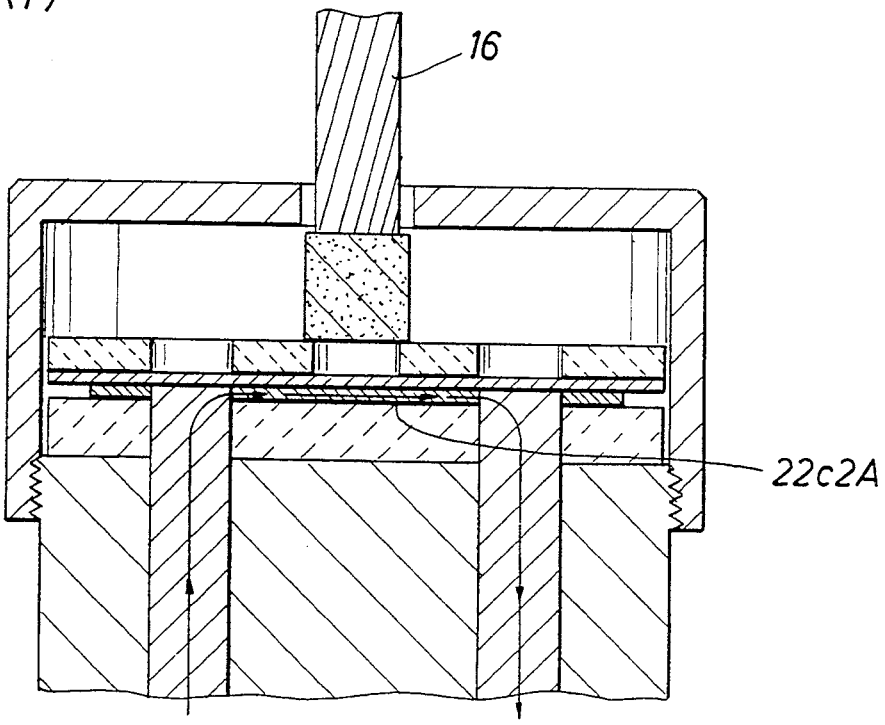
FIG. 15 (PRIOR ART)
FIGS. 15–16 illustrate longitudinal cross sectional views of the bubble activated detonator disclosed in U.S. Pat. No. 5,088,413 to Huber et al, the disclosure of which has been incorporated by reference into this specification.
Figure 16:
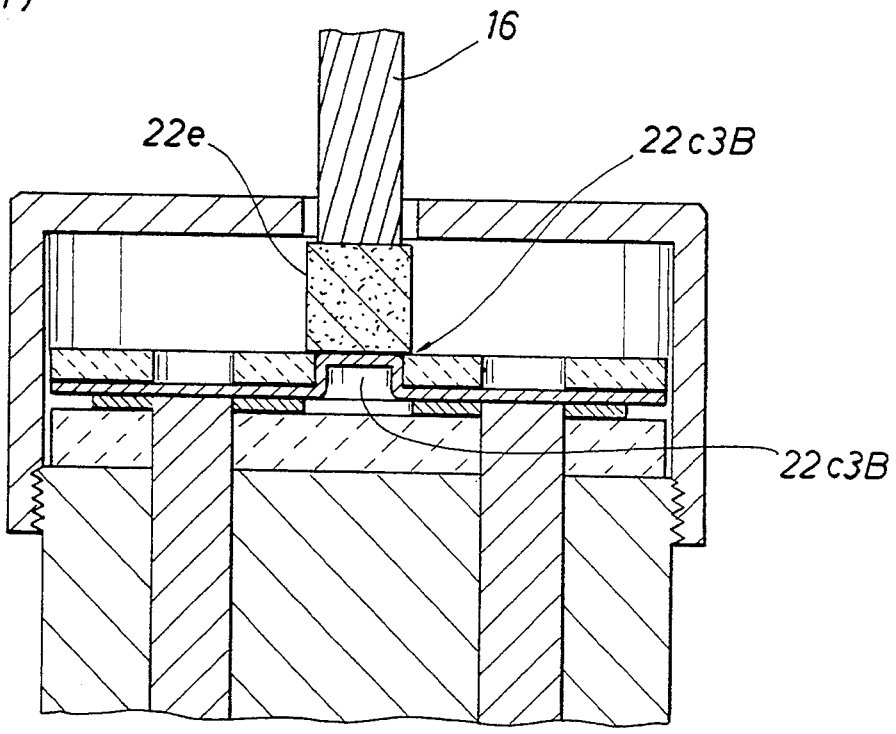
FIG. 16 (PRIOR ART)

Referring to FIGS. 15 and 16, a longitudinal cross sectional view of the prior art bubble activated detonator disclosed in U.S. Pat. No. 5,088,413 to Huber et. al. is illustrated.

In FIGS. 15 and 16, from a functional point of view, when the neck section 22c2A of the second layer 22c2 of the EFI bridge 22c vaporizes in response to a current flowing through the neck section, a turbulence is created immediately above the neck section. As a result of the turbulence, a bubble 22c3B forms in a corresponding section of the third layer 22c3 of the EFI bridge 22c. The bubble 22c3B impacts the secondary explosive 22e, the secondary explosive 22e initiating the propagation of a detonation wave in detonating cord 16. See U.S. Pat. No. 5,088,413 to Huber et. al. for further details.

Figure 17:
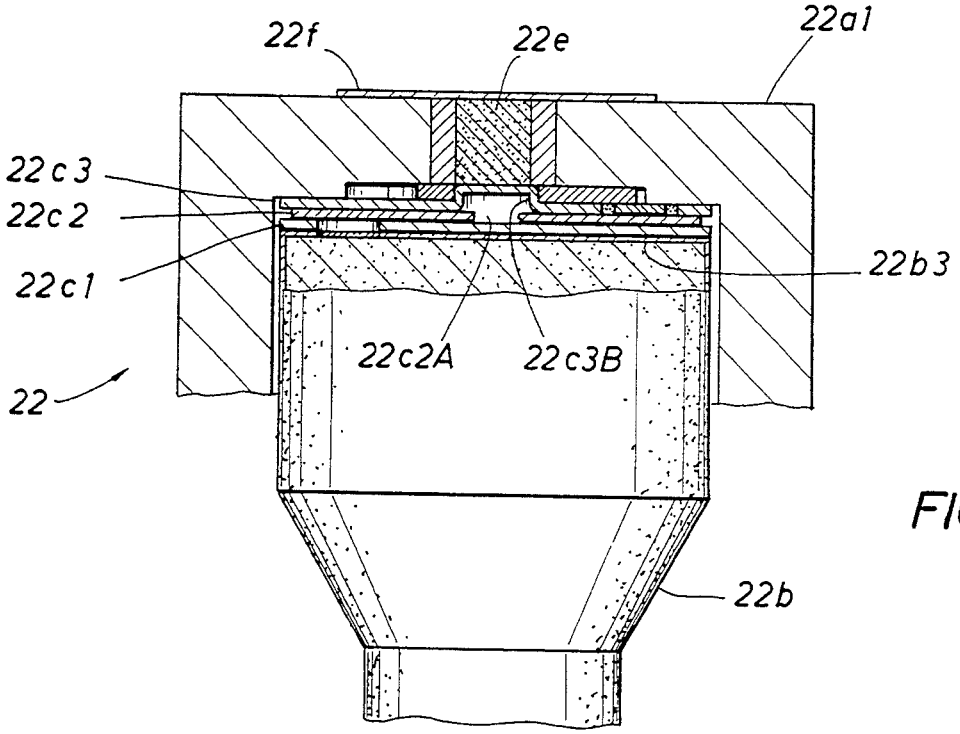
FIG. 17 illustrates a longitudinal cross sectional view of the firing head shown in FIG. 6 in a state which exists after detonation of the EFI in the firing head.

Referring to FIG. 17, a longitudinal cross sectional view of the firing head 22 shown in FIG. 6 is illustrated in a state which exists after detonation of the exploding foil initiator (EFI bridge 22c) in the firing head 22. A functional description of the operation of the firing head 22, after vaporization of the neck section 22c2A of the second layer 22c2 but immediately prior to detonation of the secondary explosive pellet 22e, will be set forth in the following paragraph with reference to FIG. 17.

In FIG. 17, when the neck section 22c2A of the second layer 22c2 of the EFI bridge 22c vaporizes, a bubble 22c3B forms in the third layer 22c3 of the EFI bridge. The bubble 22c3B forms because of turbulence which is created immediated above the neck section 22c2A after vaporization of the neck section. The bubble 22c3B impacts the secondary explosive pellet 22e. Although not shown in FIG. 17, when the pellet 22e is impacted, it detonates. Detonation of the pellet 22e causes a flying plate 22f1 (see FIG. 6) to shear out from the flyer 22f. The flying plate 22f1 impacts the booster 16a of the detonating cord 16 in FIG. 1 detonating the booster and initiating the propagation of a detonation wave in the detonating cord 16. The detonation wave detonates all the shaped charges in the perforating gun situated above the firing head 22.

Figure 18:
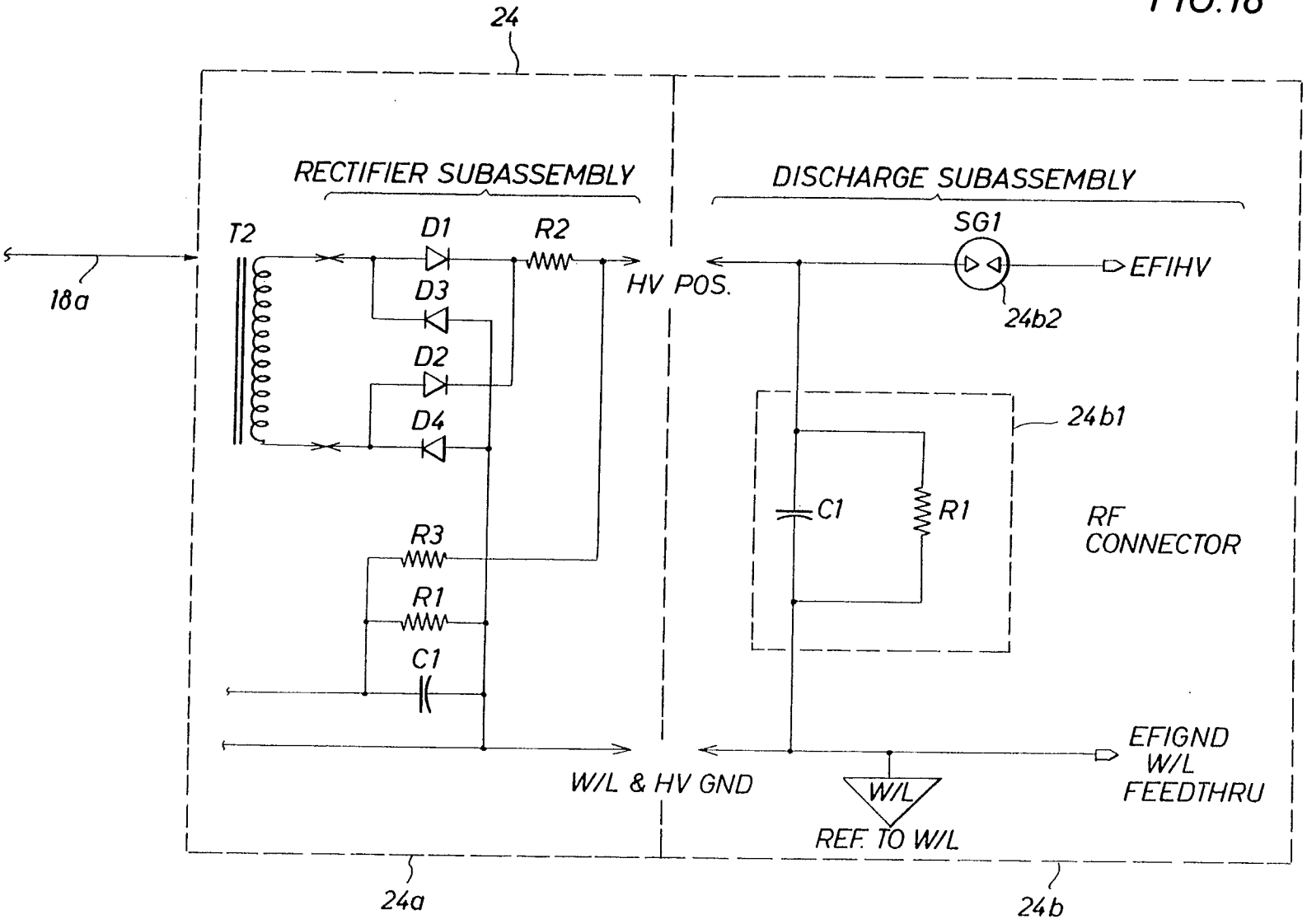
FIG. 18 illustrates the fire set circuit or power supply embodied in the firing system of FIGS. 1–2.

Referring to FIG. 18, a construction of the fire set or power supply circuit 24 of FIGS. 1–2 is illustrated.

In FIG. 18, the fire set circuit 24 includes a transformer coupled floating ground fullwave rectifier 24a and a discharge subassembly 24b. The transformer allows the output ground to be isolated in respect to all other potentials and is therefore the key for allowing the wireline current to become common with the EFI return current.

The fullwave rectifier 24a receives a high frequency AC voltage from the wireline 18 via an inverter section and converts the AC wireline voltage into a direct current (DC) voltage by full wave rectifying. The DC voltage output from the fullwave rectifier portion 24a generates a DC current which charges a capacitor 24b1 in the discharge subassembly 24b. When the capacitor 24b1 is fully charged, a gas discharge tube 24b2, known as an overvoltage gap, which functions like a switch, conducts thereby allowing the current in the charged capacitor 24b1 to pass through the gas discharge tube 24b2. The current passing through the gas discharge tube 24b2 represents the high energy discharge pulse current 24b which conducts through the pin 22b of the firing head 22 and eventually passes through the neck section 22c2A of the EFI bridge 22c thereby vaporizing the neck section of the bridge. As noted earlier, vaporization of the neck section 22c2A causes a bubble 22c3B to form in the third layer 22c3 of the EFI bridge 22c, the bubble being formed and shaped by the hole 22d1 in the EFI barrel 22d prior to impacting the secondary explosive pellet 22e. When the pellet 22e is impacted, it detonates, and detonation of the pellet 22e causes a flying plate 22f1 to shear out of the flyer 22f and fly across a space impacting the booster of detonating cord 16.

A functional description of the operation of the firing system of FIGS. 1–2 will be set forth in the following paragraphs with reference to FIGS. 1–18 of the drawings.

In FIG. 1, as previously indicated, the tie wrap 14 is a safe arm device. That is, prior to removal of the tie wrap 14, the second housing 12 cannot move toward the first housing 10; and, as a result, the ground cap 22a1 of the outer pressure bullhead housing 22a of the firing head 22 is spaced from the flyer 22f by a distance 30. Therefore, if the firing head 22 accidentally detonates, due to the distance 30, detonation of the secondary explosive pellet 22e will not shear out a flying plate 22f1 from the flyer 22f(see FIG. 6). Consequently, the booster 16a of the detonating cord 16 will not be impacted, and a detonation wave will not propagate up the detonating cord and accidentally detonate the shaped charges in the perforating gun. However, when it is time to perforate a formation traversed by a wellbore, the safe arm tie wrap device 14 must be removed. The tie wrap 14 is removed. When the tie wrap 14 is removed, the second housing 12 is moved toward the first housing 10 of the firing system in FIG. 1. When the second housing 12 moves toward the first housing 10, the distance 30 is closed and the secondary explosive pellet 22e disposed within the ground cap 22a1 of the outer pressure bulkhead housing 22a of the firing head 22 approaches and ultimately contacts the flyer 22f. When the ground cap 22a1 contacts the flyer 22f, the firing head 22 in the firing system of FIG. 1 is armed and is ready to fire.

When an operator at a surface of the wellbore wants to fire the firing system of FIGS. 1–2 and detonate a perforating gun in the wellbore, an electrical signal is transmitted down the wireline 18 into the wellbore. The signal, hereinafter known as wireline current 18a, propagates down the wireline 18, through the housing 20 which encloses booster 16a, through the outer pressure bulkhead housing 22a of the firing head 22 as shown in FIGS. 4 and 6, and energizes the fire set circuit 24 in FIGS. 6 and 18. In FIG. 18, the fullwave rectifier 24a changes the inverter high frequency wireline current 18a into a DC voltage which is input to the discharge subassembly 24b in FIG. 18. The DC voltage charges the capacitor 24b1. When the capacitor 24b1 in FIG. 18 charges to the breakover voltage of the gas discharge tube 24b2, the gas discharge tube 24b2 goes into rapid conduction. When the gas discharge tube 24b2 conducts, a current rapidly flows from the capacitor 24b1, through the gas discharge tube 24b2, and energizes the pin 22b of the firing head 22, this current, energizing the pin 22b, hereinafter being known as the EFI current 24b or the high energy discharge pulse 24b. In FIG. 4, the discharge pulse or EFI current 24b energizes the pin 22b, travels up the center of the pin 22b, crosses over to the outer pressure bulkhead housing 22a, emerging as an EFI return current 24a, and propagates down the sides of the outer pressure bulkhead housing 22a to ground potential. To be more specific, in FIGS. 6 and 14, the discharge pulse 24b propagates up the center of pin 22b and propagates through the conductive pad area 22b 1 since the insulating coating 22b3 covers substantially the entire surface area of the pin 22b except for the conductive pad area 22b1 and the bottom 22b2. The discharge pulse 24bpropagates through the conductive epoxy in hole 22c1A of the first layer 22c1, and conducts into the second layer 22c2 of the EFI bridge 22c. The discharge pulse or EFI current 24b propagates from the left hand portion 22c2C to the right hand portion 22c2D of the second layer 22c2 (see FIG. 9) via the neck section 22c2A of the second layer 22c2 .

Prior to vaporization of the neck section 22c2 A, the current which emerges from the neck section, now known as the EFI return current 24a, conducts through the crescent shaped conductive pad 22c2B on the second layer 22c2 , through the crescent shaped hole 22c3A in the third layer 22c3 via conductive epoxy, and conducts into the ground cap 22a1 of the outer pressure bulkhead housing 22a of the firing head 22 via shoulder X. The EFI return current 24a, propagating within the outer pressure bulkhead housing 22a, then flows to the edge of the ground cap 22a1 and flows, within the pressure bulkhead, down the side of the pressure bulkhead 22a to ground potential in the manner shown in FIGS.

4, 6, and 14 of the drawings. As a result, two separate and distinct currents flow simultaneously within the outer pressure bulkhead housing 22*a* of the firing head 22: the wireline current 18*a* and the EFI return current 24*a*.

However, since the discharge pulse 24*b* is conducting through the neck section 22*c*2A of the second layer 22*c*2 of the EFI bridge 22*c*, as shown in FIG. 17, the neck section 22*c*2A vaporizes thereby causing a turbulence to occur directly above the neck section and immediately below the third layer 22*c*3 of the EFI bridge 22*c*, in the same manner as described in U.S. Pat. No. 5,088,413 to Huber et. al. and as shown in FIGS. 15–16 of the drawings. This turbulence causes a bubble 22*c*3B to form in the third layer 22*c*3 of the EFI bridge, this bubble impacting the secondary explosive pellet 22*e* in FIG. 17. When the pellet 22*e* detonates, as shown in FIG. 6, a flying plate 22*f*1 shears out of the flyer 22*f*. As shown in FIG. 1, the flying plate 22*f*1 impacts the booster 16*a* of detonating cord 16 initiating the propagation of a detonation wave in the detonating cord 16. The detonation wave propagates up the detonating cord 16 in FIG. 1 detonating the shaped charges in the perforating gun.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A firing system adapted to be disposed in a wellbore tool for detonating an apparatus, said wellbore tool adapted to be disposed in a wellbore, comprising:

discharge signal generating means responsive to a first energizing signal for generating a second discharge signal;

firing means responsive to the second discharge signal for generating a return signal and detonating an explosive, said firing means including outer housing means for conducting said first energizing signal to said discharge signal generating means and for conducting said return signal to a ground potential; and detonation means responsive to the detonation of said explosive for detonating said apparatus.

2. The firing system of claim 1, wherein said first energizing signal includes a wireline signal adapted to be transmitted down a wireline to said wellbore tool when said wellbore tool is disposed in said wellbore, and wherein said discharge signal generating means comprises:

rectifier means for rectifying said wireline signal thereby generating a rectified output signal, said rectifier means including, a high voltage flyback transformer adapted for isolating said ground potential for said return signal from other potentials and allowing a potential of said wireline signal to be common with said ground potential for said return signal; charge storage means responsive to said rectified output signal for storing a charge;

switch means for changing between an open position and a closed position; and conductor means for conducting a further current from said charge storage means when said switch means changes to said closed position, said further current being said second discharge signal.

3. The firing system of claim 2, wherein said detonation means comprises a detonating cord, said apparatus including a perforating gun.

4. The firing system of claim 1, wherein said firing means comprises:

initiator means disposed within said outer housing means and responsive to said second discharge signal for generating a bubble, said bubble impacting said explosive, said explosive detonating in response to the impact.

5. The firing system of claim 4, wherein said initiator means comprises:

a conductive pin disposed within said outer housing means and adapted to conduct said second discharge signal from said discharge signal generating means, said pin having a surface area; and an insulating material adhering to substantially the entire said surface area of said pin, said insulating material defining an electrically conductive pad area on a portion of said pin where said insulating material is not disposed, said conductive pad area adapted to conduct said second discharge signal.

6. The firing system of claim 5, wherein said initiator means further comprises: exploding foil initiating means electrically connected to said conductive pad area and responsive to said second discharge signal for generating said return signal and creating a turbulence; and polyimide layer means disposed over said exploding foil initiating means for expanding to form said bubble in response to said turbulence, said bubble impacting said explosive, said explosive detonating in response to the impact.

7. The firing system of claim 6, wherein said outer housing means electrically conducts said return signal from said exploding foil initiating means to said ground potential and electrically conducts said first energizing signal to said discharge signal generating means.

8. The firing system of claim 6, wherein said exploding foil initiating means comprises:

a conductive foil having a first land area electrically connected to said conductive pad area of said pin and responsive to said second discharge signal, a second land area, and a neck section integrally connected to the first land area and the second land area, said second discharge signal electrically propagating from said first land area, through said neck section, and to said second land area, said second discharge signal in said second land area being said return signal, said neck section vaporizing in response to said second discharge signal, said turbulence being created when said neck section vaporizes.

9. The firing system of claim 8, wherein said outer housing means electrically conducts said return signal from said second land area to said ground potential and electrically conducts said first energizing signal to said discharge signal generating means.

10. The firing system of claim 8, wherein said first energizing signal includes a wireline current signal adapted to be transmitted down a wireline to said wellbore tool when said wellbore tool is disposed in said wellbore, and wherein said discharge signal generating means comprises:

rectifier means for rectifying said wireline current signal thereby generating a rectified output signal;

charge storage means responsive to said rectified output signal for storing a charge;

switch means for changing between an open position and a closed position; and conductor means for conducting a further current from said charge storage means when said switch means changes to said closed position, said further current being said second discharge signal.

11. The firing system of claim 10, wherein said outer housing means electrically conducts said return signal from said second land area of said exploding foil initiating means to said ground potential and electrically conducts said wireline current signal from said wireline to said rectifier means of said discharge signal generating means.

12. The firing system of claim 11, wherein said detonation means comprises a detonating cord, said apparatus including a perforating gun.

13. A method of detonating a firing system in a wellbore apparatus when said wellbore apparatus is disposed in a wellbore, said firing system including a firing head having an outer housing, comprising the steps of:

(a) transmitting a first signal to said firing head, (b) conducting said first signal through said outer housing of said firing head to a circuit;

(c) in response to said first signal, transmitting a second signal from said circuit to said firing head, said firing head generating a return signal;

(d) conducting said return signal through said outer housing of said firing head to a ground potential; and (e) when said second signal is transmitted to said firing head, detonating said firing system.

14. The method of claim 13, wherein said first signal is a wireline current signal adapted to conduct down a wireline when said wellbore apparatus is disposed in said wellbore, the transmitting step (a) comprising the step of:

transmitting said wireline current signal down said wireline to said firing head in said wellbore apparatus.

15. The method of claim 14, wherein the conducting step (b) comprises the step of:

conducting said wireline current signal through said outer housing of said firing head to said circuit.

16. The method of claim 15, wherein the transmitting step (c) comprises the steps of:

in response to said wireline current signal, transmitting a discharge pulse from said circuit to said firing head; and conducting said discharge pulse through a first land area of a foil, through a neck section of said foil, and into a second land area of said foil, the discharge pulse in said second land area being said return signal.

17. The method of claim 16, wherein the conducting step (d) comprises the step of:

conducting said return signal from said second land area of said foil through said outer housing of said firing head and to said ground potential.

18. The method of claim 17, wherein a polyimide layer is disposed over said foil, the detonating step (e) comprises the step of:

when said discharge pulse is conducted through said neck section of said foil, expanding a portion of said polyimide layer to form a bubble; and allowing said bubble to impact a secondary explosive, said secondary explosive detonating in response to the impact of said bubble on said secondary explosive, said firing system detonating when said secondary explosive detonates.

19. A firing system adapted to be disposed in a wellbore and responsive to a wireline signal conducted by a wireline from a surface of said wellbore when said firing system is disposed in said wellbore for detonating a wellbore apparatus, comprising:

discharge signal generating means responsive to said wireline signal for generating a discharge pulse;

firing head means connected to said discharge signal generating means for detonating an explosive, said firing head means including, initiator means responsive to the discharge pulse for generating a return signal, and an outer pressure bulkhead housing adapted for conducting said wireline signal from said wireline to said discharge signal generating means and for simultaneously conducting said return signal from said initiator means to a ground potential; and detonation means responsive to the detonation of said explosive for detonating said wellbore apparatus.

20. The firing system of claim 19, wherein said initiator means comprises:

a conductive pin disposed within said outer pressure bulkhead housing and adapted to conduct said discharge pulse from said discharge signal generating means, said pin having a surface area; and an insulating material adhering to substantially the entire said surface area of said pin, said insulating material defining an electrically conductive pad area on a portion of said pin where said insulating material is not disposed, said conductive pad area adapted to conduct said discharge pulse.

21. The firing system of claim 20, wherein said initiator means further comprises:

exploding foil initiating means electrically connected to said conductive pad area and responsive to said discharge pulse for generating said return signal and creating a turbulence; and polyimide layer means disposed over said exploding foil initiating means for expanding to form a bubble in response to said turbulence, said bubble impacting said explosive, said explosive detonating in response to the impact.

22. The firing system of claim 21, wherein said outer pressure bulkhead housing electrically conducts said return signal from said exploding foil initiating means to said ground potential and simultaneously electrically conducts said wireline signal to said discharge signal generating means.

* * * * *